US011472178B2

(12) United States Patent
Yoda

(10) Patent No.: US 11,472,178 B2
(45) Date of Patent: Oct. 18, 2022

(54) PRINTING APPARATUS

(71) Applicant: SEIKO EPSON CORPORATION, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/208,419

(22) Filed: Mar. 22, 2021

(65) Prior Publication Data

US 2021/0300032 A1 Sep. 30, 2021

(30) Foreign Application Priority Data

Mar. 24, 2020 (JP) ..... JP2020-052828

(51) Int. Cl.
*B41J 2/475* (2006.01)
*B41J 2/045* (2006.01)
*B41J 11/00* (2006.01)

(52) U.S. Cl.
CPC ..... *B41J 2/04563* (2013.01); *B41J 2/04528* (2013.01); *B41J 2/04553* (2013.01); *B41J 2/475* (2013.01); *B41J 11/003* (2013.01)

(58) Field of Classification Search
CPC ... B41J 11/0024; B41J 11/0025; B41J 11/003; B41J 2/475
See application file for complete search history.

(56) References Cited

U.S. PATENT DOCUMENTS

2016/0273832 A1* 9/2016 Asada ..... F26B 13/08
2016/0355027 A1* 12/2016 Valero Navazo .... B41J 11/0022
2018/0037022 A1 2/2018 Sasaki et al.
2020/0101766 A1 4/2020 Kizaki et al.

FOREIGN PATENT DOCUMENTS

JP 2018-020489 2/2018
JP 2020-049866 4/2020

* cited by examiner

*Primary Examiner* — Scott A Richmond
(74) *Attorney, Agent, or Firm* — Workman Nydegger

(57) ABSTRACT

A printing apparatus includes a liquid ejecting unit capable of ejecting ink, which is a liquid, onto a medium and capable of reciprocating in a width direction (X-axis direction) of the medium, a medium support unit that supports the medium on a support face, a medium width detection unit that detects a width of the medium supported on the support face, a plurality of heating units that are provided along the width direction of the medium and heat the medium support unit, and a control unit capable of individually controlling the plurality of heating units. The control unit controls an output of each of the heating units in accordance with the width of the medium detected by the medium width detection unit.

6 Claims, 4 Drawing Sheets

PRINTING APPARATUS

The present application is based on, and claims priority from JP Application Serial Number 2020-052828, filed Mar. 24, 2020, the disclosure of which is hereby incorporated by reference herein in its entirety.

BACKGROUND

1. Technical Field

The present disclosure relates to a printing apparatus such as an inkjet printer.

2. Related Art

A printing apparatus (JP-A-2018-20489) is known that supports a medium on a support face of a medium support unit provided with a plurality of heating units, and that performs printing on the medium while heating the medium.

In the above-described printing apparatus, the temperature of end portions of the medium is more likely to drop than that of portions other than the end portions. Since portions of the support face on the outside of the end portions of the medium are exposed, the exposed portions are easily affected by the outside air, and the temperature of the exposed portions is likely to drop. As a result of being affected by the temperature drop in the exposed portions, the temperature of the end portions of the medium is more likely to drop than that of portions other than the end portions. When the temperature of the end portions of the medium drops, the temperature in the width direction of the medium becomes uneven, and there is a possibility that a printed image quality may deteriorate.

However, in JP-A-2018-20489, there is no mention or suggestion of the problem arising from the temperature drop in the end portions of the medium.

SUMMARY

In order to solve the problem described above, a printing apparatus according to the present disclosure includes a liquid ejecting unit configured to eject a liquid onto a medium, a medium support unit configured to support the medium at a support face, a medium width detection unit configured to detect a width of the medium supported at the support face, a plurality of heating units provided along a width direction of the medium and configured to heat the medium support unit, and a control unit configured to individually control the plurality of heating units. The control unit controls an output of each of the heating units in accordance with the width of the medium detected by the medium width detection unit.

DESCRIPTION OF EXEMPLARY EMBODIMENTS

Figure 1:
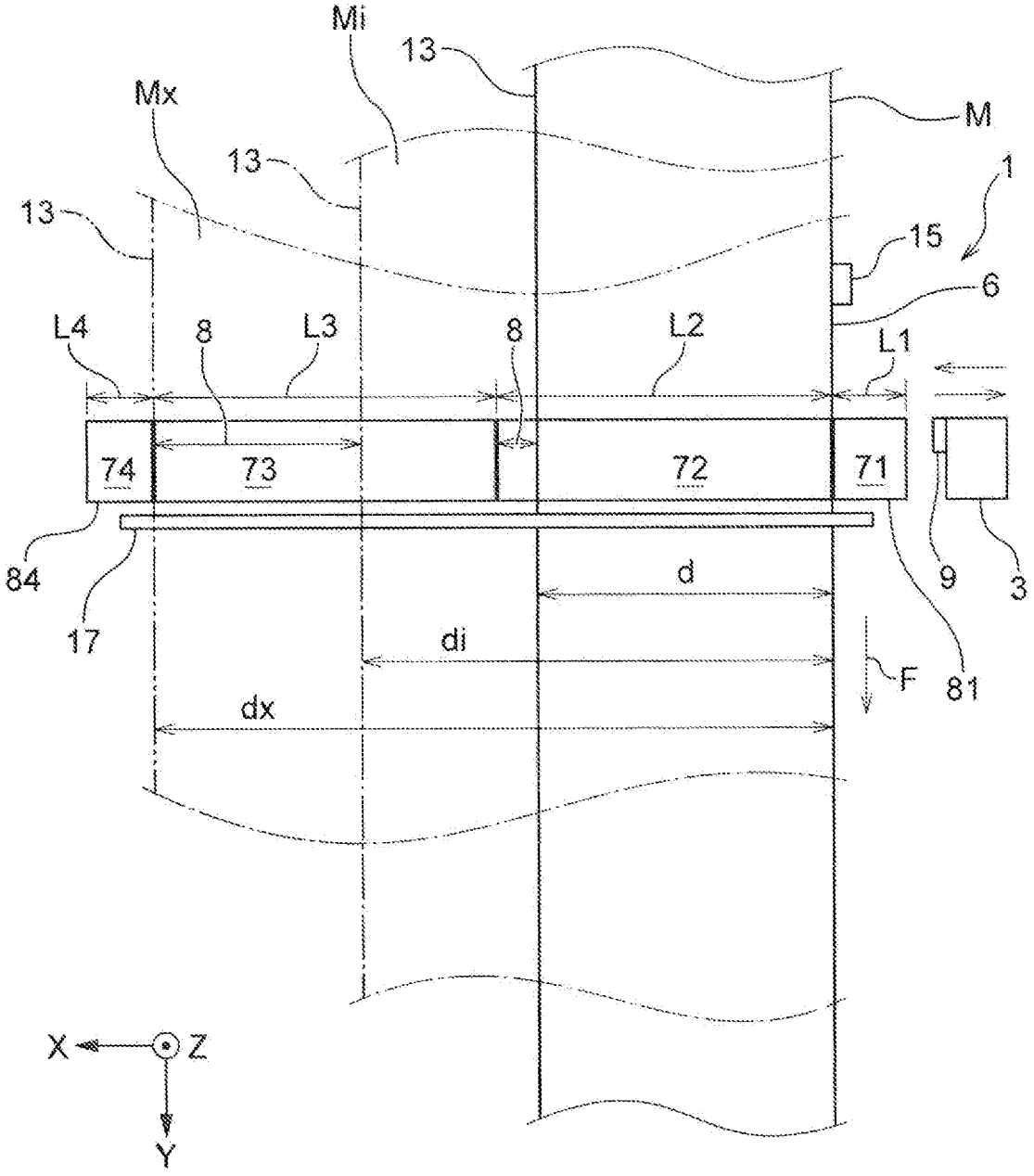
FIG. 1 is a schematic plan view illustrating main portions of a printing apparatus according to a first embodiment.

First, the present disclosure will be schematically described below.

In order to solve the problem described above, a printing apparatus according to a first aspect includes a liquid ejecting unit configured to eject a liquid onto a medium, a medium support unit configured to support the medium at a support face, a medium width detection unit configured to detect a width of the medium supported at the support face, a plurality of heating units provided along a width direction of the medium and configured to heat the medium support unit, and a control unit configured to individually control the plurality of heating units. The control unit controls an output of each of the heating units in accordance with the width of the medium detected by the medium width detection unit.

According to this aspect, the control unit controls the output of each of the heating units in accordance with the width of the medium. As a result, heating control taking into account a side edge position of the medium can be performed, and thus a temperature drop in an end portion of the medium can be suppressed in the printing apparatus that performs printing on the medium while heating the medium. Thus, a deterioration in a printed image quality arising from temperature variations can be suppressed.

In the printing apparatus according to a second aspect of the present disclosure, with respect to the first aspect, the control unit controls the output of each of the heating units in accordance with a side position of the medium, the side position being based on a detection result of the width of the medium by the medium width detection unit.

According to this aspect, since the output of each of the heating units is controlled in accordance with the side position of the medium, a temperature drop in the end portion of the medium can be suppressed.

With respect to the second aspect, the printing apparatus according to a third aspect includes a plurality of temperature detection units each configured to detect a temperature of each of heating areas corresponding to each of the heating units in the medium support unit, and the control unit controls the output of each of the heating units based on a relationship between the side position of the medium that is based on the detection result of the medium width detection unit and a position of each of the temperature detection units, and on a detection result of each of the temperature detection units.

According to this aspect, the control unit controls the output of each of the heating units based on the relationship between the side position of the medium and each of the positions of the temperature detection units, and on the detection result of each of the temperature detection units. As a result, even if the temperature of an exposed portion of the support face on the outside of the end portion of the medium changes due to an influence from the surrounding environment, the temperature change can be responded to in a highly responsive manner Thus, the temperature drop in the end portion of the medium can be suppressed.

In the printing apparatus according to a fourth aspect, with respect to the third aspect, the control unit controls the output of each of the heating units by individually setting a target temperature for each of the heating units.

According to this aspect, the control unit controls the output of each of the heating units by individually setting the target temperature for each of the plurality of heating units. As a result, the control becomes easy.

In the printing apparatus according to a fifth aspect, with respect to any one of the second to fourth aspects, the medium support unit includes an alignment unit that aligns a side of the medium with one end side in the width direction of the medium support unit, and the side position is a side on another end side of the medium that is in a state of being aligned by the alignment unit.

According to this aspect, the side position is the side on the other end side of the medium that is in the state of being aligned by the alignment unit. As a result, since only one side of the medium becomes an object to be controlled, the control becomes easy.

In the printing apparatus according to a sixth aspect, with respect to the fifth aspect, each of the temperature detection units is disposed at an end, on an opposite side from the alignment unit, of each of heating areas in a range in which the medium is transported, each of the heating areas corresponding to each of the heating units in the medium support unit.

According to this aspect, each of the temperature detection units is disposed at the end, on the opposite side from the alignment unit, of each of the heating areas in the range in which the medium is transported, each of the heating areas corresponding to each of the heating units in the medium support unit. As a result, the temperature drop due to the exposure is detected in a highly responsive manner. Further, since output control of each of the heating units can be performed based on a simple linear equation expressing a relationship between the side position of the medium and the position of each of the temperature detection units, the control becomes easy.

In the printing apparatus according to a seventh aspect, with respect to any one of the second to sixth aspects, the medium support unit is provided with an end portion temperature maintaining unit for the medium, on an outside of the side position of the medium that has a maximum width.

According to this aspect, since the end portion temperature maintaining unit for the medium is provided on the outside of each of the side positions of the medium having the maximum width that can be printed by the printing apparatus, when the medium having the maximum width is set, the temperature drop in the end portions of the medium can be suppressed.

With respect to any one of the first to seventh aspects, the printing apparatus according to an eighth aspect includes an air flow supply unit configured to supply an air flow to the medium on the support face.

According to this aspect, drying of the medium is promoted by the air flow from the air flow supply unit, but at the same time, the temperature in the exposed portion more easily drops. Thus, effects of applying the present disclosure to such a structure becomes significant.

First Embodiment

A recording device according to a first embodiment of the present disclosure will be described in detail below, with reference to FIG. 1 to FIG. 3.

In the following description, three mutually orthogonal axes are denoted as an X-axis, a Y-axis, and a Z-axis, respectively, as illustrated in each of the drawings. A Z-axis direction corresponds to the vertical direction (the direction in which gravity acts). An X-axis direction and a Y-axis direction correspond to the horizontal direction. Here, the Y-axis direction corresponds to a transport direction of a medium, and the X-axis direction corresponds to a width direction of the medium intersecting the transport direction.

In those drawings, an inkjet printer is illustrated as an example of a printing apparatus 1. The printing apparatus 1 records various types of information by ejecting ink, which is an example of a liquid, onto a medium M. Examples of the medium M include various materials such as paper (roll paper, cut sheet paper, and the like) and textile (woven fabric, cloth, and the like).

Figure 2:
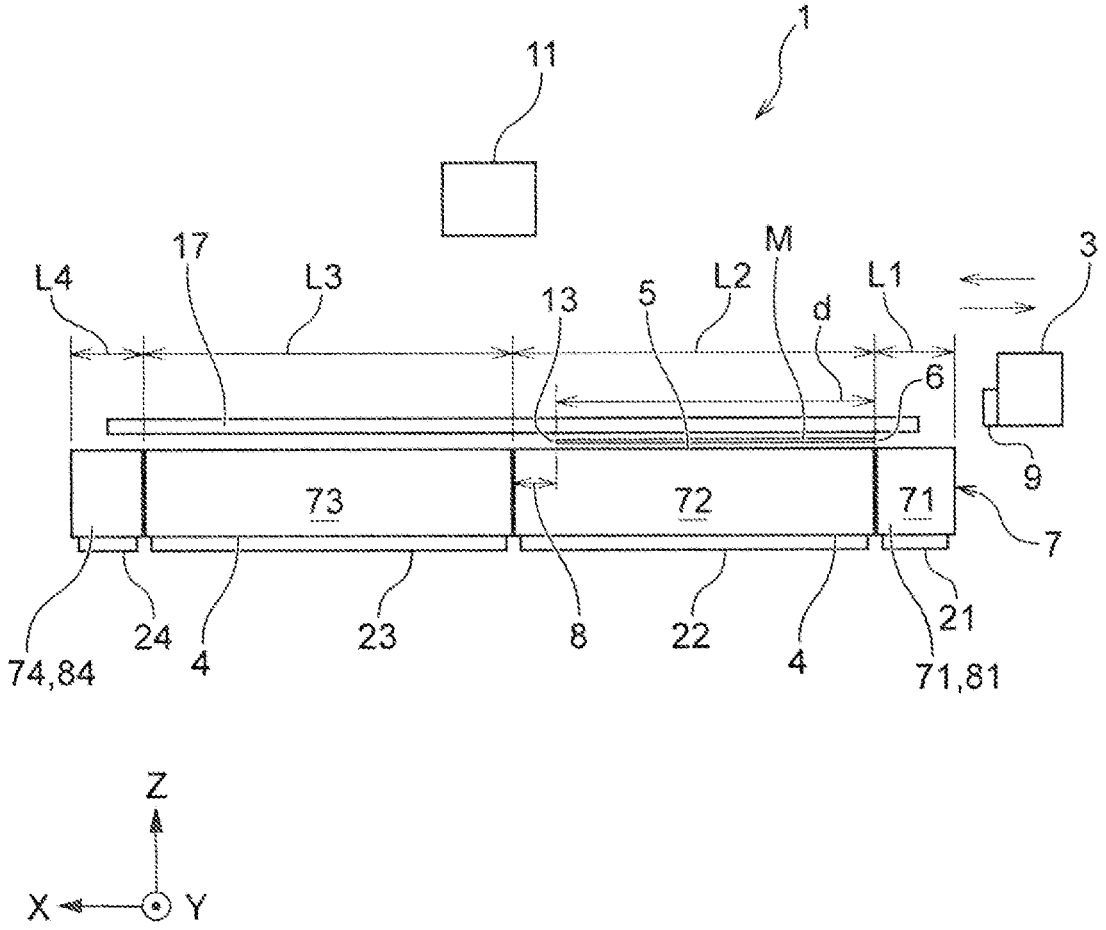
FIG. 2 is a schematic front view illustrating the main portions of the printing apparatus according to the first embodiment.

As illustrated in FIG. 1 and FIG. 2, in this embodiment, the printing apparatus 1 includes a liquid ejecting unit 3 that is capable of ejecting ink, which is a liquid, onto the medium M and reciprocating in the width direction (X-axis direction) of the medium M, a medium support unit 7 that supports the medium M on a support face 5, a medium width detection unit 9 that detects a width d of the medium M supported on the support face 5, a plurality of heating units 21, 22, 23, and 24 that are provided along the width direction of the medium M and heat the medium support unit 7, and a control unit 11 that is capable of individually controlling the plurality of heating units 21, 22, 23, and 24.

The control unit 11 is configured to control an output of each of the heating units 21, 22, 23, and 24 in accordance with the width d of the medium M detected by the medium width detection unit 9.

Each of the components of the printing apparatus 1 will be described in detail below.

Liquid Ejecting Unit

The liquid ejecting unit 3 includes a plurality of nozzle rows (not illustrated) that eject ink droplets. The liquid ejecting unit 3 is also referred to as a discharge head, a printing head, a recording head, or the like.

In this embodiment, colors of the ink are four colors, namely, cyan, magenta, yellow, and black. However, the colors are not limited to those four colors, and may be one or two of those four colors, or five or more colors including light magenta and the like.

The liquid ejecting unit 3 receives a control signal from the control unit 11, and records image information by ejecting the ink onto the medium M while reciprocating in the width direction intersecting a transport direction F of the medium M.

In this embodiment, both unidirectional recording, in which the ink is ejected only when the liquid ejecting unit 3 is moving in one direction of the reciprocating movement, and bidirectional recording in which the ink is ejected when the liquid ejecting unit 3 is moving in both a forward direction and a return direction of the reciprocating movement, are performed.

Medium Support Unit and Heating Units

The medium support unit 7 includes the support face 5 that is flat and can support the medium M. The medium M is transported by a transport roller (not illustrated) while being caused to slide on the support face 5 in the transport direction F (the Y-axis direction). The support face 5 is formed so as to be as flat as necessary to support the medium M and to make a gap between the medium M and the ejection nozzles of the liquid ejecting unit 3, namely, a paper gap, constant.

The four electric heating units 21, 22, 23, and 24 are provided along the width direction of the medium M on a back surface 4, of the medium support unit 7, which is a surface on the opposite side from the support face 5. Here, the number of heating units is not limited to four, and may be three, or five or more. In this embodiment, the medium support unit 7 is divided into four heating areas 71, 72, 73, and 74 by the four heating units 21, 22, 23, and 24.

Medium Width Detection Unit

The medium width detection unit 9 detects the width d of the medium M supported on the support face 5. In this embodiment, an optical reflective sensor is used as the medium width detection unit 9. The medium width detection unit 9 detects a position of a side 13 of the medium M and the width d, using the fact that a reflectance changes at a boundary defined by the side position 13, which is an end portion of the medium M in the width direction.

It is sufficient that the medium width detection unit 9 be able to detect information regarding the width of the medium M, and it goes without saying that the medium width detection unit 9 is not limited to the optical reflective sensor.

In this embodiment, the medium support unit 7 includes an alignment unit 15 that aligns a side 6 of the medium M to a first end side in the width direction. As illustrated in FIG. 2, the alignment unit 15 is disposed so as to have a boundary between the heating area 71 and the heating area 72 as an alignment position.

In a state in which the side 6 is aligned with the alignment unit 15, the position of the side 13 is the position of a side on a second end side in the width direction of the medium M. The printing apparatus 1 has a structure in which the medium M is set while being aligned with reference to one side in the width direction, and the position of the side 13 varies depending on the size of the width of the medium M.

The width d of the medium M can be determined by the medium width detection unit 9 detecting the position of the side 13, using the alignment unit 15 as a reference position. In other words, in this embodiment, when detecting the width d of the medium M, the width d of the medium M can be easily detected, as it is only necessary to detect the position of the one side, that is, the side 13 of the medium M.

Note that when a structure is adopted in which the alignment unit 15 is not provided, the width d of the medium M is determined by the medium width detection unit 9 detecting both the positions of the side 6 and the side 13.

Control Unit and Heating Units

Figure 3:
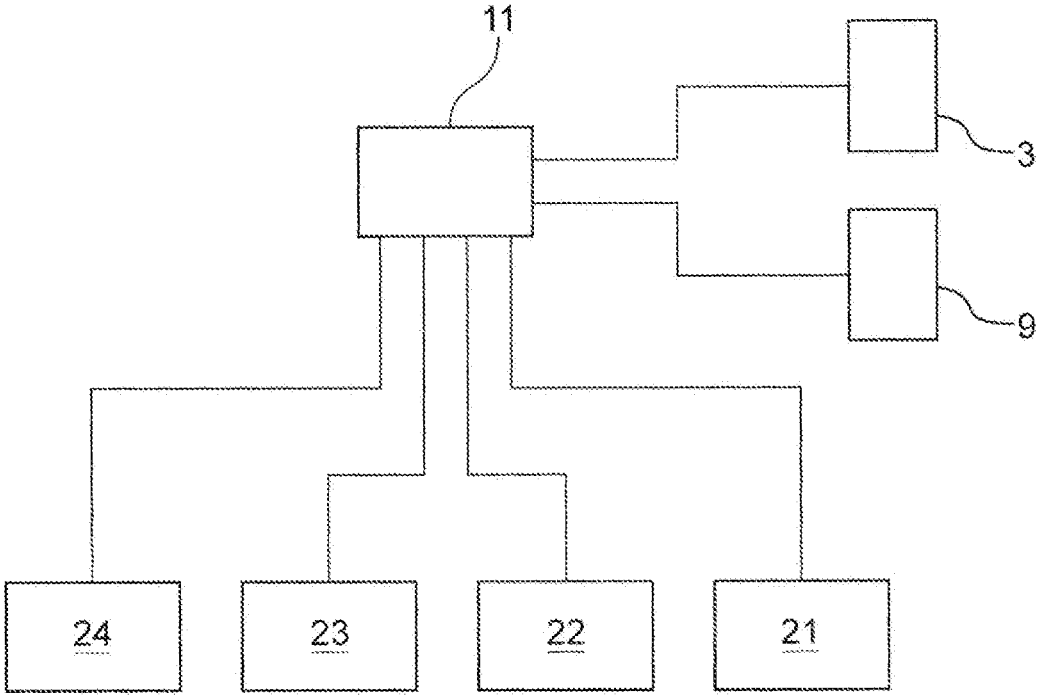
FIG. 3 is a block configuration diagram illustrating the main portions of the printing apparatus according to the first embodiment.

As illustrated in FIG. 3, the control unit 11 can individually control the output of each of the heating units 21, 22, 23, and 24 using a control signal.

Then, the control unit 11 is configured to control the output of each of the heating units 21, 22, 23, and 24 in accordance with the width d of the medium M detected by the medium width detection unit 9.

Specifically, the control unit 11 is configured to individually control the output of each of the heating units 21, 22, 23, and 24 respectively provided in the four heating areas 71, 72, 73, and 74 in accordance with the width d of the medium M detected by the medium width detection unit 9. When the lengths of the four heating areas 71, 72, 73, and 74 in the width direction are L1, L2, L3, and L4, respectively, L1=L4 and L2=L3 are satisfied in this embodiment. In addition, L1<L2 is also satisfied.

Further, in this embodiment, a configuration is adopted in which the medium M is transported while being supported on the support face 5 of the heating areas 72 and 73, provided on the center side, of the four heating areas 71, 72, 73, and 74.

Output of Each Heating Unit

In this embodiment, with respect to each of the widths d of the media M having different widths from each other, an appropriate size of the output for each of the heating units 21, 22, 23, and 24 is determined in advance and stored in a storage unit (not illustrated) as a table. Although it is sufficient that the appropriate size of the output for each of the heating units 21, 22, 23, and 24 be determined in advance with respect to each of the widths d of the plurality of media M assumed to be used in the printing apparatus 1, it is preferable that the size of the output for each of the heating units 21, 22, 23, and 24 be determined in advance with respect to many other widths d including those other than the above-described widths d. Furthermore, when the appropriate size of the output for each of the heating units 21, 22, 23, 24 is determined in advance for each of the widths d corresponding to each type of the media M and prepared as a table, even more appropriate heating can be performed.

The control unit 11 is configured such that the medium width detection unit 9 detects the width d of the medium M actually transported on the support face 5, and each of the heating units 21, 22, 23, and 24 is driven by the output, set in the table, corresponding to the detection result. Note that when output information corresponding to the width d of the medium M detected by the medium width detection unit 9 does not exist in the table, each of the heating units 21, 22, 23, and 24 is driven by an output set for a width closest to the detected width d.

End Portion Temperature Maintaining Unit

Further, in this embodiment, as illustrated in FIG. 1, a medium Mx having a maximum width dx that can be printed by the printing apparatus 1 has the same width as the length in the width direction of the two heating areas 72 and 73, that is, L2+L3. In other words, in a state in which the side 6 of the medium Mx is aligned with the alignment unit 15, the side 13 on the second side is positioned on a boundary between the heating area 73 and the heating area 74. The other two heating areas 71 and 74 are positioned on the outside of the sides 6 and 13, respectively, of the medium Mx.

The heating units 21 and 24 respectively corresponding to the two heating areas 71 and 74 function as end portion temperature maintaining units 81 and 84 for the medium M, which are positioned on the outside of the sides 6 and 13, respectively, of the medium Mx and are configured to maintain the temperature of the sides 6 and 13, respectively, of the medium Mx so as to prevent the temperature thereof from dropping.

An example of a medium Mi having a width di between the width d of the medium M and the width dx of the medium Mx, is illustrated in FIG. 1. The medium Mi has a dimension covering the entire heating area 72 and a portion of the heating area 73. Note that, as illustrated in FIG. 1, the medium M has a dimension covering a portion of the heating area 72.

The printing apparatus 1 according to this embodiment includes an air flow supply unit 17 that supplies an air flow to the medium M on the support face 5 of the medium support unit 7. The air flow promotes drying of the ink ejected onto the medium M. In this way, when the air flow supply unit 17 is provided, the drying of the medium M is promoted by the air flow, but on the other hand, the temperature of an exposed portion more easily drops.

In such a structure, effects of the control unit 11 controlling the output of each of the heating units 21, 22, 23, and 24 in accordance with the detected width d of the medium M are significant.

In this embodiment, the control unit 11 is configured to control the output of each of the heating units 21, 22, 23, and 24 in accordance with the side position 13 of the medium M determined based on the detection result of the width d of the medium M by the medium width detection unit 9. As described above, since the side 6 of the medium M is aligned by the alignment unit 15, the position of the side 13 on the second side of the medium M corresponds to the width d of the medium M.

Description of Actions of First Embodiment

Actions and effects of the printing apparatus 1 according to the first embodiment will be described below with reference to FIG. 1 and FIG. 2.

(A) Heating Control when Printing on Medium M in FIG. 1

The width d of the medium M is shorter than the length L2 of the heating area 72, as illustrated in FIG. 1. In FIG. 1, a reference sign 8 denotes the exposed portion. When this short width d is detected by the medium width detection unit 9, the output of each of the heating units 21, 22, 23, and 24 is controlled based on the detection result and the table.

Control of the above-described output will be described in detail. With the output of the heating unit 22 in a state in which the entire heating area 72 is covered by the medium M, heating becomes insufficient due to effects of heat dissipation from the exposed portion 8, and the temperature of a portion of the side 13 of the medium M drops. Thus, it is necessary to increase the output of the heating unit 22 in order to suppress the temperature drop. At this time, when the output of the heating unit 22 is too high, even if the temperature drop in the portion of the side 13 can be suppressed, the heating temperature in other portions becomes too high. In the table, the output of the heating unit 22 is appropriately set for each of the plurality of media M having the different widths d from each other, so that the output of the heating unit 22 can suppress the temperature drop in the portion of the side 13, and the heating in the other portions does not become excessive.

Specifically, the heating unit 21 is set to have an output to allow the heating unit 21 to function as the end portion temperature maintaining unit 81, the heating unit 22 is set to have an appropriate output based on the table, the heating unit 23 is turned off or set to have a small supplementary output to maintain the temperature of the side 13, that is, to prevent the temperature of the side 13 from dropping, and the heating unit 24 is turned off.

(B) Heating Control when Printing on Medium Mi in FIG. 1

As illustrated in FIG. 1, the width di of the medium Mi is longer than the length L2 of the heating area 72 and shorter than the length L2+L3 obtained by adding the length L3 of the heating area 73 to the length L2. In FIG. 1, the reference sign 8 denotes the exposed portion. When this width di is detected by the medium width detection unit 9, the output of each of the heating units 21, 22, 23, and 24 is controlled based on the detection result and the table.

Control of the above-described output will be described in detail. Since the entire heating area 72 is covered by the medium Mi, the output of the heating unit 22 in that state is set in the table.

With the output of the heating unit 23 in a state in which the entire heating area 73 is covered by the medium Mi, heating becomes insufficient due to the effects of heat dissipation from the exposed portion 8, and the temperature of the portion of the side 13 of the medium Mi drops. Thus, it is necessary to increase the output of the heating unit 23 in order to suppress the temperature drop. At this time, when the output of the heating unit 23 is too high, even if the temperature drop in the portion of the side 13 can be suppressed, the heating temperature in other portions becomes too high. In the table, the output of the heating unit 23 is appropriately set for each of the plurality of media Mi having the different widths di from each other, so that the output of the heating unit 23 can suppress the temperature drop in the portion of the side 13, and the heating in the other portions does not become excessive.

Specifically, the heating unit 21 is set to have the output to allow the heating unit 21 to function as the end portion temperature maintaining unit 81, the heating unit 22 and the heating unit 23 are each set to have an appropriate output based on the table, and the heating unit 24 is turned off or set to have a small supplementary output to maintain the temperature of the side 13, that is, to prevent the temperature of the side 13 from dropping.

(C) Heating Control when Printing on Medium Mx in FIG. 1

As illustrated in FIG. 1, the width dx of the medium Mx is the same length as the length L2+L3 obtained by adding the length L3 of the heating area 73 to the length L2 of the heating area 72. When this width dx is detected by the medium width detection unit 9, the output of each of the heating units 21, 22, 23, and 24 is controlled based on the detection result and the table.

Control of the above-described output will be described in detail. Since both the entire heating area 72 and the entire heating area 73 are covered by the medium Mx, the output of each of the heating unit 22 and the heating unit 23 in that state is set in the table.

Specifically, the heating unit 21 is set to have the output to allow the heating unit 21 to function as the end portion temperature maintaining unit 81, the heating unit 22 and the heating unit 23 are each set to have an appropriate output based on the table, and the heating unit 24 is set to have an output to allow the heating unit 24 to function as the end portion temperature maintaining unit 84.

(D) Heating Control when No Output Information Matching Detected Width d of Medium M Exists in Table In this case, each of the heating units 21, 22, 23, and 24 is driven by an output set in the table for a width closest to the detected width d.

Description of Effects of First Embodiment (1) According to this embodiment, the control unit 11 controls the output of each of the heating units 21, 22, 23, and 24 in accordance with the width d of the medium M. As a result, heating control taking into account side edge positions of the medium M can be performed, and thus the temperature drop in the end portions of the medium M can be suppressed in the printing apparatus that performs printing on the medium M while heating the medium M. Thus, a deterioration in a printed image quality arising from temperature variations can be suppressed.

(2) Further, according to this embodiment, the control unit 11 controls the output of each of the heating units 21, 22, 23, and 24 in accordance with the position of the side 13 of the medium M based on the detection result of the width d of the medium M, and thus the temperature drop in the end portions of the medium M can be suppressed.

(3) Further, according to this embodiment, the medium support unit 7 includes, on the first end side in the width direction, the alignment unit 15 that aligns the side 6 of the medium M, and the position of the side 13 is the position of the side of the medium M, on the second end side, obtained in the state in which the medium M is aligned with the alignment unit 15. As a result, since only the side 13 of the medium M on the one side becomes an object to be controlled, the control becomes easy.

(4) Further, according to this embodiment, since the end portion temperature maintaining units 81 and 84 for the medium M are provided on the outside of the positions of the sides 6 and 13, respectively, of the medium Mx having the maximum width dx that can be printed by the printing apparatus 1, when the medium Mx having the maximum width is set, the temperature drop in the end portions of the medium Mx can be suppressed.

Second Embodiment

The recording device according to a second embodiment of the present disclosure will be described below with reference to FIG. 4.

Note that the same reference signs will be assigned to common components with the first embodiment, and a description thereof will be omitted. Further, a description of the same actions and effects as those of the first embodiment will also be omitted.

Temperature Detection Unit

In this embodiment, a plurality of temperature detection units 31, 32, 33, and 34 are further provided that respectively detect the temperature of each of the heating areas 71, 72, 73, and 74 corresponding to each of the heating units 21, 22, 23, and 24 in the medium support unit 7. As a result of the temperature detection units 31, 32, 33, and 34 being provided, control can be performed while taking into account changes in the temperature due to an influence from the surrounding environment of the exposed portion. Thermistors are used as the temperature detection units 31, 32, 33, and 34.

Then, the control unit 11 is configured to control the output of each of the heating units 21, 22, 23, and 24 based on a detection result of each of the temperature detection units 31, 32, 33, and 34 and on a relationship between the position of the side 13 of the medium M, determined based on the detection result of the medium width detection unit 9, and the position of each of the temperature detection units 31, 32, 33, and 34.

When the position of the side 13 of the medium M on the support face 5 is detected by the medium width detection unit 9, an overlapping state of the medium M with respect to each of the heating areas 71, 72, 73, and 74 is identified. In other words, the presence or absence of the exposed portion 8 and a degree of the exposure are determined with respect to each of the heating areas 71, 72, 73, and 74. This point is the same as in the first embodiment.

In this embodiment, in addition to the above, the relationship between the position of the side 13 of the medium M and the position of each of the temperature detection units 31, 32, 33, and 34 is also identified. In other words, it is identified whether each of the temperature detection units 31, 32, 33, and 34 is in a state of being positioned in the exposed portion 8 or in a state of being covered by the medium M. The detection result of each of the temperature detection units 31, 32, 33, and 34 varies depending on whether each of the temperature detection units 31, 32, 33, and 34 is in the state of being positioned in the exposed portion 8 or in the state of being covered by the medium M. In the covered state, the detection result is a high temperature, and in the exposed state, the detection result is a low temperature. As a result, when the control unit 11 controls the output of each of the heating units 21, 22, 23, and 24 in accordance with the width of the medium M, it is possible to use the detection result of each of the temperature detection units 31, 32, 33, and 34 while taking into account the different states.

Target Temperature

Further, in this embodiment, the control unit 11 is configured to control the output of each of the heating units 21, 22, 23, and 24 by individually setting a target temperature for each of the heating units 21, 22, 23, and 24. Specifically, a configuration is adopted in which the output of each of the heating units 21, 22, 23, and 24 is adjusted, and each of the heating units 21, 22, 23, and 24 is driven so that the target temperature is obtained by each of the temperature detection units 31, 32, 33, and 34.

Further, in this embodiment, each of the temperature detection units 31, 32, 33, and 34 is disposed in each of the heating areas 71, 72, 73, and 74 corresponding to each of the heating units 21, 22, 23, and 24 in the medium support unit 7. Specifically, of the four temperature detection units 31, 32, 33, and 34, the two temperature detection units 32 and 33 are disposed in the two heating areas 72 and 73 positioned within a range in which the medium M is transported, at respective ends thereof on the opposite side from the alignment unit 15. In other words, the two temperature detection units 32 and 33 are respectively disposed at the left ends of the two heating areas 72 and 73 in FIG. 4.

Figure 4:
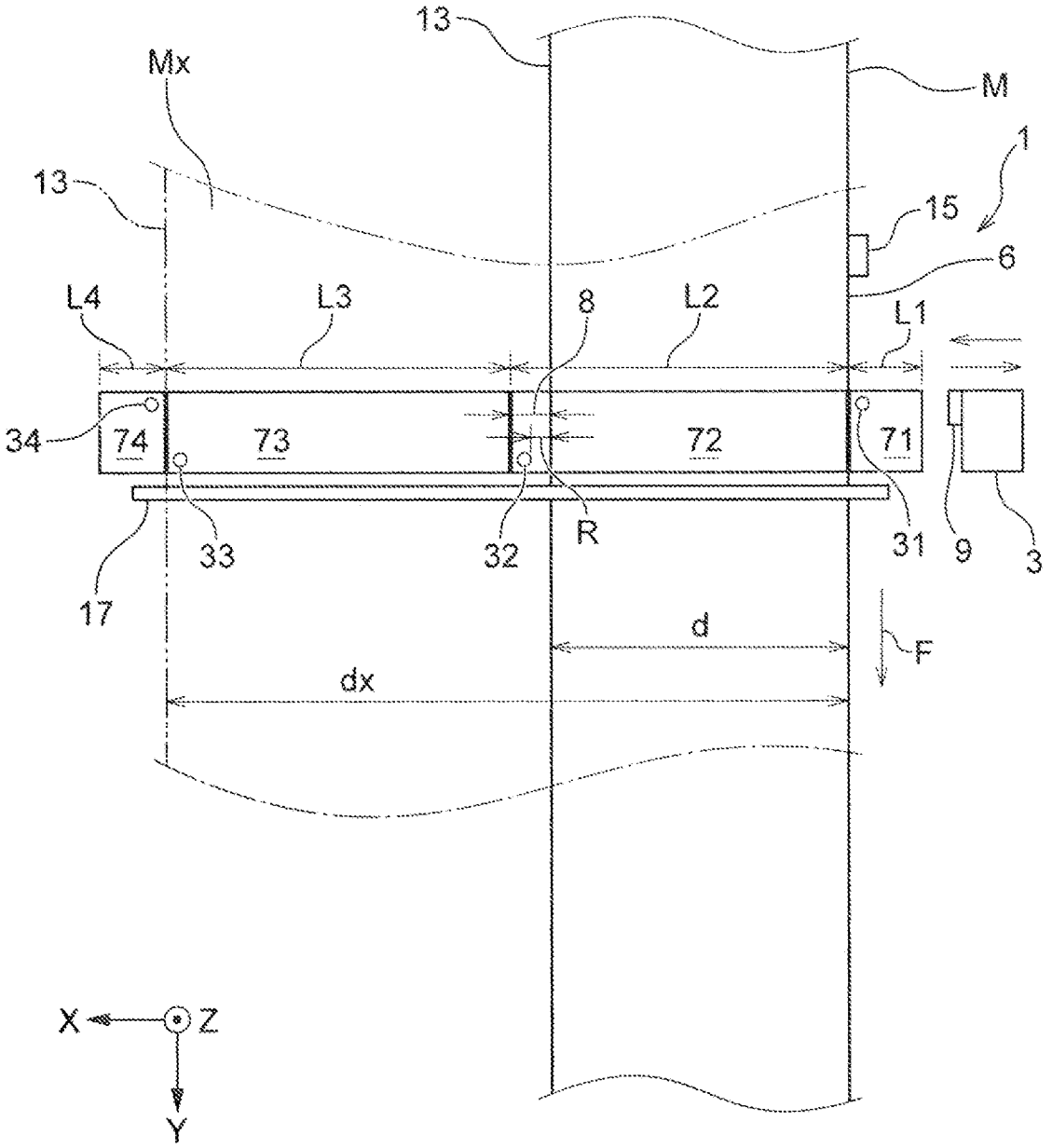
FIG. 4 is a schematic plan view illustrating main portions of the printing apparatus according to a second embodiment.

Note that the two other temperature detection units 31 and 34 are respectively disposed in the heating areas 71 and 74 at positions illustrated in FIG. 4.

As a result of the two temperature detection units 32 and 33 being respectively disposed at the left ends (FIG. 4) of the heating areas 72 and 73, the following becomes possible.

For example, when the width d of the medium M is the same as the length L2 of the heating area 72 in FIG. 4, a state is obtained in which the entire heating area 72 is covered by the medium M. Next, a case in which the width d of the medium M is reduced from this state will be described.

As illustrated in FIG. 4, in this embodiment, the temperature detection unit 32 is positioned at the left end of the heating area 72. Thus, when the width d of the medium M becomes smaller, the temperature detection unit 32 is immediately positioned in the exposed portion 8 that occurs in a portion on the left side of the heating area 72 (the medium M in FIG. 1). As a result, the temperature detection unit 32 can detect the temperature drop. In other words, in response to the change in the width of the medium M, the temperature detection unit 32 can detect that the exposed portion 8 has occurred on the left side of the heating area 72 in a highly responsive manner.

When the width d of the medium M becomes even smaller, the area of the exposed portion 8 increases. As a result, an amount of heat dissipation in the exposed portion 8 increases, and thus the temperature drops even further. A relationship between changes in a distance R between the temperature detection unit 32 and the side 13 of the medium M, and changes in the temperature detected by the temperature detection unit 32 was investigated. As a result, it was confirmed that the detected temperature almost always decreases as the distance R increases, and a relationship between the detected temperature and the distance R can be expressed by an almost linear function.

Relationship Between Output Control of Heating Units and Distance R

The smaller the width d of the medium M becomes, the larger the area of the exposed portion 8 becomes, and if the output of the heating unit 22 is maintained at the same level, the temperature of the end portion (the portion of the side 13) of the medium M drops. As already described above in the first embodiment, the output of the heating unit 22 needs to be increased in order to suppress the temperature drop. A relationship between an increase of the output of the heating unit 22 and the distance R was investigated. As a result, it was confirmed that the relationship between the increase of the output and the distance R can be expressed by an almost linear function.

Based on the above-described confirmation results, in this embodiment, in order to control the output of each of the heating units 21, 22, 23, and 24 in accordance with the width d of the medium M, the above-described linear function is determined in advance, and the determined linear function is stored in the storage unit of the control unit 11 or the like, so as to be available for use. Then, when the printing apparatus 1 performs the printing on the medium M, the output of each of the heating units 21, 22, 23, and 24 can be controlled using the linear function.

In other words, the width d of the medium M can be detected by the medium width detection unit 9, the distance R can be determined based on the detected width d, and the output corresponding to the determined distance R can be determined using the above-described linear function. As a result, output control of the heating units 21, 22, 23, and 24 is easily performed.

Description of Effects of Second Embodiment (1) According to this embodiment, the control unit 11 controls the output of each of the heating units 21, 22, 23, and 24 based on the relationship (the distance R) between the position of the side 13 of the medium M and each of the positions of the temperature detection units 31, 32, 33, and 34, and on the detection result of each of the temperature detection units 31, 32, 33, and 34. As a result, even if the temperature of the exposed portion 8 of the support face 5 on the outside of the end portion of the medium M changes due to the influence from the surrounding environment, the temperature change can be responded to in a highly responsive manner Thus, the temperature drop in the end portion of the medium M can be suppressed.

(2) Further, according to this embodiment, the control unit 11 controls the output of each of the heating units 21, 22, 23, and 24 by individually setting the target temperature for each of the plurality of heating units 21, 22, 23, and 24. As a result, the control becomes easy.

(3) Further, according to this embodiment, the temperature detection units 32 and 33 are respectively disposed in the heating areas 72 and 73 positioned within the range in which the medium M is transported, of the heating areas 71, 72, 73, and 74 respectively corresponding to the heating units 21, 22, 23, and 24 in the medium support unit 7, at the ends of the heating areas 72 and 73 on the opposite side from the alignment unit 15. As a result, the temperature drop due to the exposed portion 8 is detected in a highly responsive manner. Further, since the output control of each of the heating units 21, 22, 23, and 24 can be performed based on the simple linear equation expressing the relationship between the position of the side 13 of the medium M and the position of each of the temperature detection units 32 and 33, the control becomes easy.

Other Embodiments

The printing apparatus 1 according to each of the embodiments of the present disclosure is based on the configuration described above, but as a matter of course, modifications, omission, and the like may be made to a partial configuration without departing from the gist of the disclosure of the present application.

In each of the above-described embodiments, the printing apparatus is described having the structure that includes the alignment unit 15 to align the position, in the width direction, of the medium M, using the reference on the one side, but a structure in which the alignment in the width direction is performed using a center reference or another structure may be employed, as long as the width d can be detected by the medium width detection unit 9 detecting the positions of the sides 6 and 13 of the medium M.

What is claimed is:

1. A printing apparatus comprising:

a liquid ejecting unit configured to eject a liquid onto a medium;

a medium support unit configured to support the medium at a support face;

a medium width detection unit configured to detect a width of the medium supported at the support face;

a plurality of heating units provided along a width direction of the medium and configured to heat the medium support unit;

a plurality of temperature detection units each configured to detect a temperature of each of heating areas corresponding to each of the heating units in the medium support unit; and a control unit configured to individually control the plurality of heating units, wherein the control unit controls an output of each of the heating units in accordance with the width of the medium detected by the medium width detection unit, the control unit controls the output of each of the heating units in accordance with a side position of the medium, the side position being based on a detection result of the width of the medium by the medium width detection unit, and the control unit controls the output of each of the heating units based on a relationship between the side position of the medium that is based on the detection result by the medium width detection unit and a position of each of the temperature detection units, and on a detection result by each of the temperature detection units.

2. The printing apparatus according to claim 1, wherein the control unit controls the output of each of the heating units by individually setting a target temperature for each of the heating units.

3. The printing apparatus according to claim 1, wherein each of the temperature detection units is disposed at an end, on an opposite side from the alignment unit, of each of heating areas in a range in which the medium is transported, each of the heating areas corresponding to each of the heating units in the medium support unit.

4. The printing apparatus according to claim 1, wherein the medium support unit is provided with an end portion temperature maintaining unit for the medium, on an outside of the side position of the medium that has a maximum width.

5. The printing apparatus according to claim 1, comprising:

an air flow supply unit configured to supply an air flow to the medium at the support face.

6. A printing apparatus comprising:

a liquid ejecting unit configured to eject a liquid onto a medium;

a medium support unit configured to support the medium at a support face;

a medium width detection unit configured to detect a width of the medium supported at the support face;

a plurality of heating units provided along a width direction of the medium and configured to heat the medium support unit; and a control unit configured to individually control the plurality of heating units, wherein the control unit controls an output of each of the heating units in accordance with the width of the medium detected by the medium width detection unit, the control unit controls the output of each of the heating units in accordance with a side position of the medium, the side position being based on a detection result of the width of the medium by the medium width detection unit, the medium support unit includes an alignment unit that aligns a side of the medium with one end side in the width direction of the medium support unit, and the side position is a side on another end side of the medium that is in a state of being aligned by the alignment unit.

* * * * *